US006761097B2

(12) United States Patent
Petersen

(10) Patent No.: US 6,761,097 B2
(45) Date of Patent: Jul. 13, 2004

(54) METHOD FOR CUTTING MULTISIZE PHOTOGRAPHIC PRINTS

(75) Inventor: David M. Petersen, Escondido, CA (US)

(73) Assignees: Hewlett-Packard Development Company, L.P., Houston, TX (US); Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/995,092

(22) Filed: Nov. 27, 2001

(65) Prior Publication Data

US 2003/0097916 A1 May 29, 2003

(51) Int. Cl.[7] ..... B26D 3/00; B26D 5/20

(52) U.S. Cl. ..... 83/42; 83/39; 83/56; 83/256; 83/614; 83/948

(58) Field of Search ..... 83/35, 39, 42, 83/56, 948, 614, 256; 198/624, 457.02; 271/225, 184

(56) References Cited

U.S. PATENT DOCUMENTS

| | | | | | |
|---|---|---|---|---|---|
| 2,348,457 | A | * | 5/1944 | Drehs | 355/54 |
| 3,224,306 | A | * | 12/1965 | Hawley et al. | 83/23 |
| 3,688,619 | A | * | 9/1972 | Yabuta | 83/35 |
| 3,933,069 | A | * | 1/1976 | Tall et al. | 83/210 |
| 4,009,957 | A | * | 3/1977 | Suzuki et al. | 399/195 |
| 4,203,334 | A | * | 5/1980 | Zettler | 83/23 |
| 4,283,902 | A | | 8/1981 | Giori | |
| 4,341,135 | A | * | 7/1982 | Ufermann et al. | 83/23 |
| 4,507,166 | A | * | 3/1985 | Posner | 156/235 |
| 4,909,374 | A | * | 3/1990 | Skrypalle | 198/371.3 |
| 4,972,743 | A | * | 11/1990 | Nojima | 83/76.8 |
| 5,360,161 | A | | 11/1994 | Schaller et al. | |
| 5,365,817 | A | * | 11/1994 | Maeda et al. | 83/256 |
| 5,586,479 | A | | 12/1996 | Roy et al. | |
| 6,050,562 | A | * | 4/2000 | Long | 271/10.03 |
| 6,126,283 | A | | 10/2000 | Wen et al. | |
| 6,217,167 | B1 | | 4/2001 | Wen et al. | |
| 6,386,671 | B1 | * | 5/2002 | Huston et al. | 347/16 |

FOREIGN PATENT DOCUMENTS

DE 195 15 705 C1 10/1996

* cited by examiner

*Primary Examiner*—Allan N. Shoap
*Assistant Examiner*—Isaac Hamilton
(74) *Attorney, Agent, or Firm*—Stephen B. Salai, Esq.; Roger Aceto, Esq.; Harter, Secrest & Emery LLP

(57) ABSTRACT

A cutter system for cutting a larger sheet into individual photographic images includes a cutter for severing a transverse strip containing one or more printed images from a larger sheet. A transport table positioned to receive the strip from the cutter includes two sets of drivers, one set for moving the strip longitudinally and a second set for moving the strip laterally to a second cutter that in turn separates the strip into individual photographs. Sensors in both cutters acting in response to fiducial marks on the larger sheet cooperate with the drivers for positioning the larger sheet and the severed strip at the proper cutting locations.

7 Claims, 4 Drawing Sheets

METHOD FOR CUTTING MULTISIZE PHOTOGRAPHIC PRINTS

CROSS REFERENCE TO RELATED CASES

The application is related to copending application Ser. No. 10/020,397 filed Dec. 12, 2001.

FIELD OF THE INVENTION

The present invention relates to a method and apparatus for cutting a plurality of photographic prints from a larger sheet.

BACKGROUND OF THE INVENTION

It is conventional in photofinishing systems to use rolls of photographic paper that are the exact width of the finished print. Individual prints are cut from the roll with a single cross cut. Conventional systems also can produce prints of various lengths. This is done to accommodate modern cameras that include the capability of recording images of various selected lengths. For example the camera user can select any one of several lengths of images ranging from a wide-angle image to a much shorter image. However, each print produced by conventional photofinishing systems must be of the same width.

A change in the desired width of the print requires changing the width of the print medium. This has been done by manually changing the roll of photographic paper being used or by designing a photofinishing machine that has multiple feed units each stocked with a specific width of photographic paper. An alternative approach is to use multiple feed trays each stocked with single sheets for making a single print of a given size. This eliminates the need for cross cutting the print from a roll but still limits size selection to the exact size loaded into the selected feed tray.

Recent advances in photofinishing allow for the production of photographs by ink jet printers, laser printers and other photofinishing printer systems not dependent on traditional wet chemistry. Moreover, the use of computers in connection with these advancements allows for further improvement. For example, it is not necessary to use roll stock having the width of the desired photograph. A photofinishing printer can now generate photos of various sizes on a single sheet of print media. Also the images can be manipulated to arrange photos of different sizes on a single sheet.

The throughput speed of an ink jet printer, laser printer or the like is dependent upon the width of the printed page in that the use of a wider paper allows for an increase in the printed area per unit of time. When using such a printer, it is preferred as a matter of convenience to feed the printer with sheets of a single width. This presents the problem of severing multiple images of various widths from a single larger sheet.

Accordingly, it is an object of the present invention to provide a method and apparatus for cutting prints of various sizes from a larger sheet.

Another object is to provide a method and apparatus for orthogonally moving a sheet beneath cutters in order to sever prints of various widths from a larger sheet.

A further object of the present invention is to provide a method and apparatus for cutting prints of various sizes from a larger sheet including a transport mechanism for moving a sheet beneath orthogonally arranged cutters.

OBJECTS OF THE INVENTION

Briefly, the method and apparatus of the present invention operates on a sheet containing an array of smaller images.

The sheet is provided by a photofinishing system that prints a set of images on a larger sheet having a defined length and width. The prints are arranged on the sheet in rows and the prints in each row share a common dimension, either width or length. Also the prints are aligned in the row such that the common dimension extends longitudinally. With this arrangement, the photographs in each row have leading and trailing edges that are aligned. The sheet is moved longitudinally into a cutter and as the sheet enters an inlet end of the cutter, the sheet is clamped and a transverse cut is made. The transverse cut severs a strip containing a row of photographs. The strip of photographs then is moved in a transverse direction towards an outlet end of the cutter and is advanced through the outlet end in a stepwise fashion. With each pause in the stepwise advance, the strip is clamped and a lateral cut is made to sever an individual print from the strip. The process then repeats for the next row of prints on the sheet.

Accordingly, the present invention may be characterized in one aspect thereof by a method for separating a sheet of photographic prints into individual prints comprising:

a) providing a sheet of photographic prints wherein the prints are arranged on the sheet in an orthogonal pattern composed of transverse rows, the prints defining each transverse row having aligned leading and trailing edges;

b) moving the sheet longitudinally along a first path of travel into a cutter inlet end;

c) cutting the sheet at the inlet end along a line perpendicular to the first path of travel to sever from the sheet a first strip containing a first row of prints;

d) moving the severed strip to a cutter outlet end along a second path of travel that is perpendicular to the first path of travel;

e) advancing the strip through the outlet end in a stepwise fashion that pauses the movement at a lateral edge of each print; and f) cutting the strip at each pause in the movement along a line perpendicular to the second path of travel to sever individual prints from the strip.

In another aspect the present invention may be characterized by an apparatus for separating a sheet of photographic prints into individual photographs comprising:

a) a cutter table having an inlet end and a distal outlet end, the outlet end being arranged orthogonally to the inlet end;

b) a sheet driver for moving a sheet of photographs longitudinally along a first path of travel into a cutter inlet end, the photographs being arranged on the sheet in an orthogonal pattern composed of transverse rows, the prints defining each transverse row having aligned leading and trailing edges;

c) a first cutter at the inlet end for cutting the sheet along a line perpendicular to the first path of travel to sever from the sheet a strip containing a first row of prints;

d) a first set of strip movers on the table for moving the severed strip in the direction of the first path of travel to an end of the table opposite the inlet end;

e) a second set of strip movers on the table for advancing the strip in a stepwise fashion to a cutter outlet end along a second path of travel that is perpendicular to the first path of travel, each stepwise advance being followed by a pause for locating a lateral edge of a print at the outlet end; and f) a second cutter at the outlet end operable during a pause in the stepwise advance to cut the strip along a lateral edge of a print that is perpendicular to the second path of travel to separate individual prints from the strip.

DETAILED DESCRIPTION OF THE INVENTION

Figure 1:
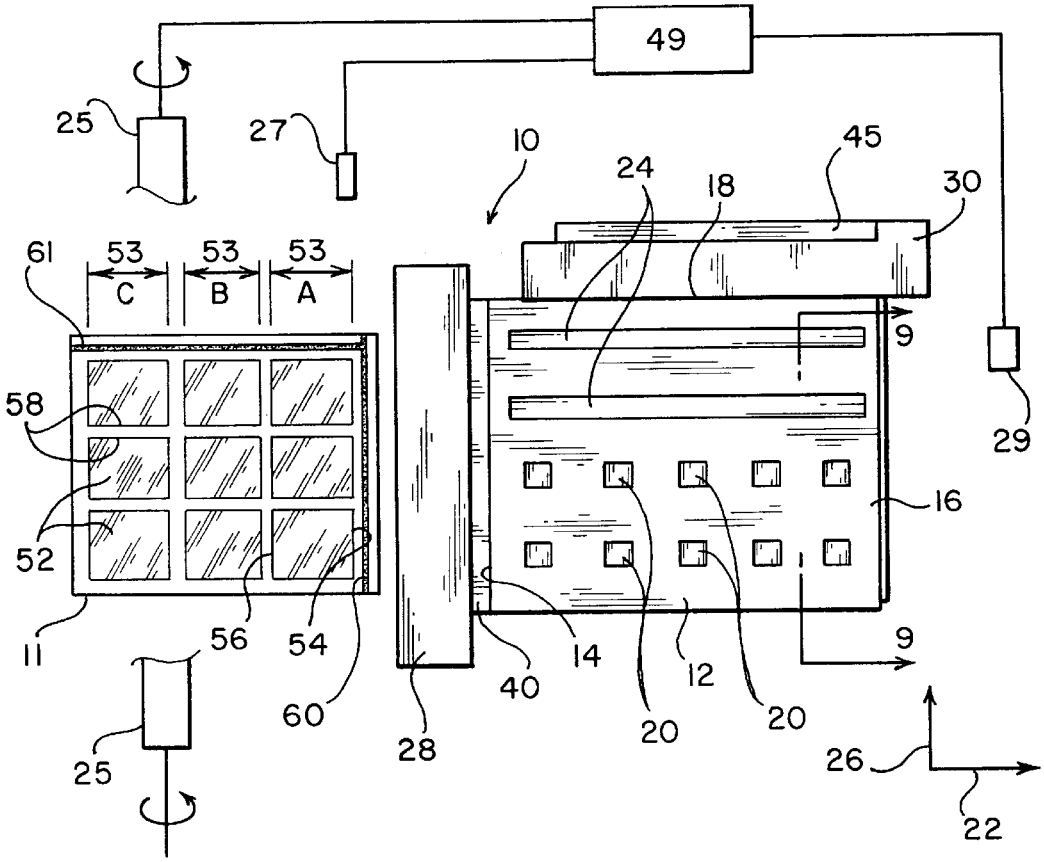
FIGS. 1–6 are schematic plan views showing a transport table and steps in the cutting of individual prints from a single sheet containing a plurality of photographic prints.

Referring to the drawings, FIGS. 1–6 shows a sequence of steps for severing individual prints from a sheet 11 containing a plurality of prints. In this respect the cutter and transporter of the present invention, portions of which is indicated at 10, includes a transport table 12. The table has an inlet end 14 at one side, an opposite end 16 and an exit end 18 disposed at the rear of the table orthogonal and adjacent to the inlet end. While not limited to size, an embodiment of the invention has a table that is of a size able to accommodate a web width of about 28 to 32 cm and a full web length of up to about 51 cm.

Incorporated into the transport table 12 is a driver system for moving a sheet first longitudinally from the inlet end 14 to the opposite end 16 and then transversely along the opposite end 16 to the table exit 18. Portions of the driver system as shown in FIG. 1 include a plurality of longitudinally spaced driven rollers 20. The rollers preferably are arranged in pairs and are disposed for moving a sheet along the table in a longitudinal path of travel indicated by arrow 22 that extends from the inlet end 14 and towards the opposite end 16. These rollers 20 extend through openings in the table and are grouped generally towards the front of the table as viewed in FIG. 1.

Figure 4:
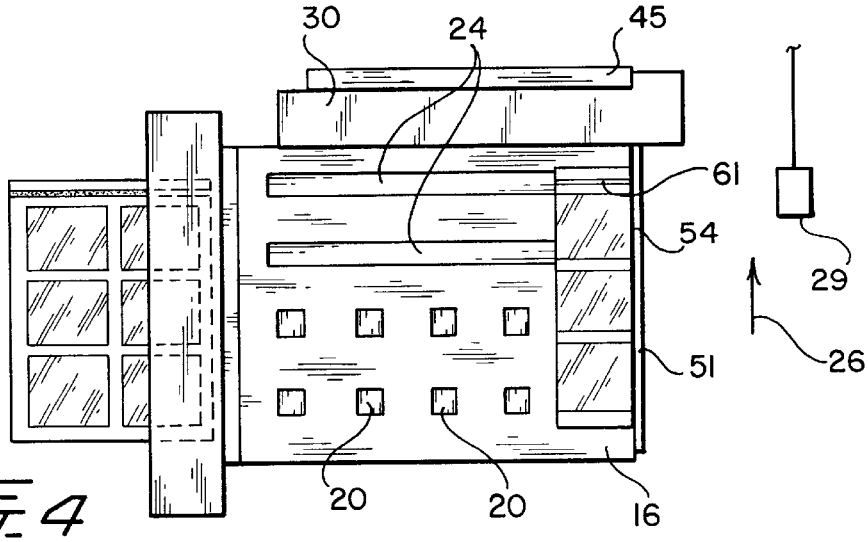
Figure 5:
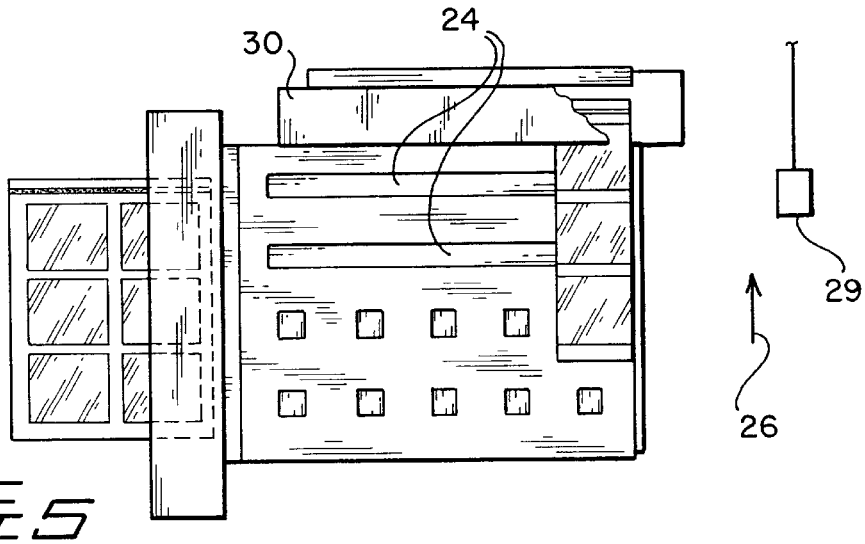

A second set of driven rollers 24, also extending through openings in the table, are arranged for moving a sheet along a second path of travel indicated by arrow 26 that is perpendicular to the first path in a transverse direction across the table and towards the table exit 18. As shown in FIGS. 1, 4 and 5, the second set of driven rollers 24 is arranged along side the first set of driven rollers 20 and extend substantially the full length of the table from the inlet end 14 to the opposite end 16.

Figure 9:
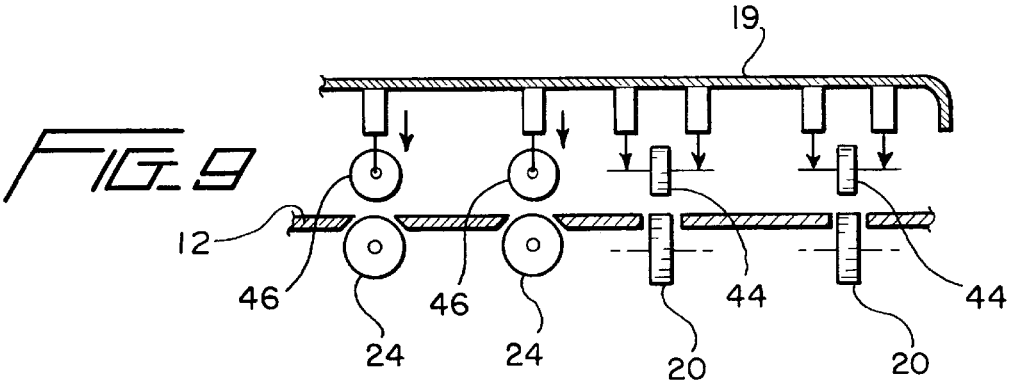
FIG. 9 is a view taken along lines 9—9 of FIG. 1 on an enlarged scale showing a schematic representation of additional components of the transport table not seen in FIG. 1.

As best seen in FIG. 9, a housing 19 is disposed over the table (the housing being removed from FIGS. 1–6 for viewing the table). Supported within the housing are first and second sets of idler pinch rollers 44, 46 respectively. The set of idler pinch rollers 44 is arranged for movement so as to create a nip with the driven rollers 20. Forming the nip acts to drive a sheet caught in the nip in a longitudinal direction across the transport table (in the direction of arrow 22 in FIG. 1). The second set of idler pinch rollers 46 is arranged for movement so as to create a nip with the driven rollers 24. This acts to drive a sheet caught in the nip in a transverse direction across the table and towards the exit 18 in the direction of arrow 26 (FIG. 1). The two sets of idler rollers 44, 46 are independently controlled so that there is selected movement in both the longitudinal and transverse directions.

Figure 7:
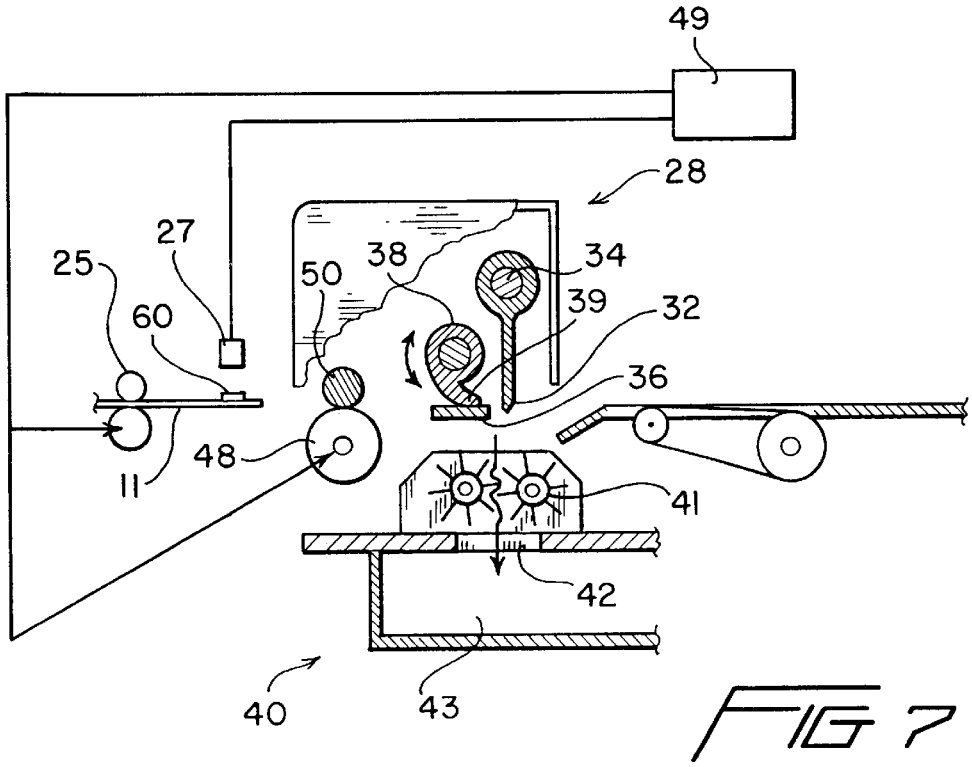
FIG. 7 is a front elevation view, partly broken away and in section showing a cutter at the inlet end of a transport table.
Figure 8:
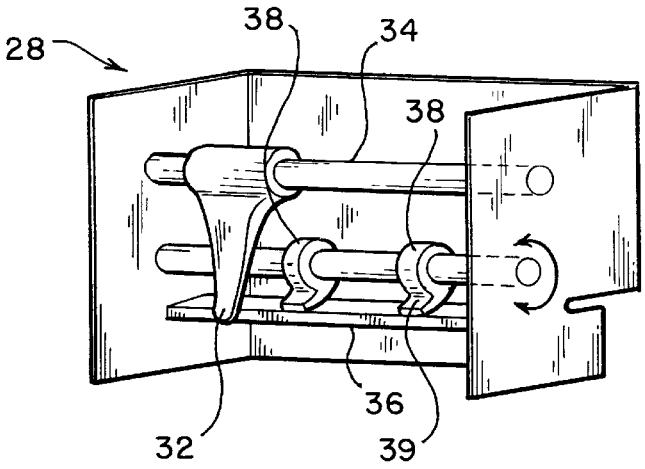
FIG. 8 is an isometric view showing a portion of the cutter at the inlet end from a reverse angle.

Disposed adjacent both the table inlet and outlet ends 14, 18 are cutter mechanisms 28, 30 respectively. Located in advance of cutter 28 is a sensor 27 such as an LED emitter-detector. A similar sensor 29 is located in advance of cutter 30 (FIG. 1). Both sensors 27, 29 are connected to a controller 49 for purposes set out hereinbelow. The cutter mechanisms 28, 30 have substantially the same construction so only cutter mechanism 28 is described in detail. As seen in FIGS. 7, and 8, cutter mechanism 28 at the inlet end includes a rotary knife 32 that is supported on a mandrel 34 extending perpendicular to the first path of travel 22. The knife is movable along the mandrel and against an anvil 36 for shearing off a piece of the sheet 11. Preceding the knife along the path of travel is a set of paper clamps 38.

Clamps 38 are mounted for pivotal movement between open and a closed position. Each clamp includes a foot portion 39 that in the closed position (as shown in the Figures) bear against the anvil 36. In the closed position the feet 39 operate to apply a force for holding the sheet 11 against the anvil 36 and in position during a cutting operation. Following the knife along the path of travel is a waste collector generally indicated at 40 (a similar waste collector 45 being associated with cutter 30). The waste collector is arranged to receive any portion of the sheet that is removed by the cutter mechanism. In this respect the waste collector is disposed generally below the anvil 36 and includes a pair of counter rotating augers 41. These augers insure that any piece cut from the sheet by the rotating knife 32 is drawn downwards through an opening 42 and into a waste receptacle 43.

To complete the construction, each cutter mechanism includes a registration roller 48 that nips with a pinch roller 50 for delivering a sheet 11 to the cutter as described hereinbelow. Preferably, a stepper motor (not shown) drives the registration roller. The stepper motor for driving the registration roller 48 is controlled in part by a controller 49 that receives an input from sensors 27 and 29.

Operation will be described with reference to FIGS. 1 and 7 as beginning with a sheet 11 being delivered to the cutter mechanism. The sheet contains a plurality of individual photographic prints 52 applied by an ink jet printer or the like. As shown in FIG. 1, the sheet measures about 33×50.8 cm and contains an array of nine individual prints each measuring about 10.16×15.24 cm. The prints are arranged in an array that contains rows 53A, B and C extending across the sheet and columns extending along the sheet. The prints in each row have aligned leading and trailing edges 54, 56 respectively and the prints in each column have aligned lateral edges 58. It should be appreciated that while nine similar size prints are shown, prints of various sizes can be arranged on the sheet so long as the prints in each row have one dimension (either length or width) in common so as to present aligned leading and trailing edges 54,56. The second dimension (length or width) of the prints in each row can vary. If all the prints are of equal size as shown, the columns will have aligned lateral edges 58. However, each row can contain images of various sizes and where the prints do not have a second dimension in common the lateral edges 58 will not be aligned. For example, given a sheet 11 that is thirteen inches wide, a first row 53A may be printed with two 4×6 images; or a 4×6 image and two 4×3 images; or a 4×9 image and a 4×3 image. A next row 53B might contain two 5×7 images; or a single 8×10 or 5×12 image. It only is important that the images in each row have one dimension in common and that the sum of the second dimensions plus the trim waste does not exceed the width of sheet 11.

Preferably each image is slightly oversize to allow for a non-precision cut location. Also, the array of prints on the sheet is surrounded by a fiducial mark. A first fiducial mark 60 comprises a dark transverse stripe located in advance of the leading edge 54 of the first row 53A of prints. This fiducial mark provides for the detection of the first row of prints entering the transport table inlet end 14. A second fiducial mark 61 comprising a dark longitudinal stripe extends the length of the sheet 11 adjacent at least one side of the sheet, preferably the side towards the rear of the transport table. The fiducial mark 61 lies between the sheet edge and the lateral edge 58 of the column of prints adjacent this sheet edge.

The sheet is delivered to the cutter mechanism 28 by a carrier, a portion of which is shown at 25 that is operated by the controller 49 (FIG. 1). It should be noted that as part of the operation for printing the images on the sheet, the controller is provided with a memory of the print layout. This memory, for example, includes information as to the distance between the leading and trailing edges 54, 56 of each row 53A, B and C as well as the length in the transverse direction of each print in each row.

Figure 2:
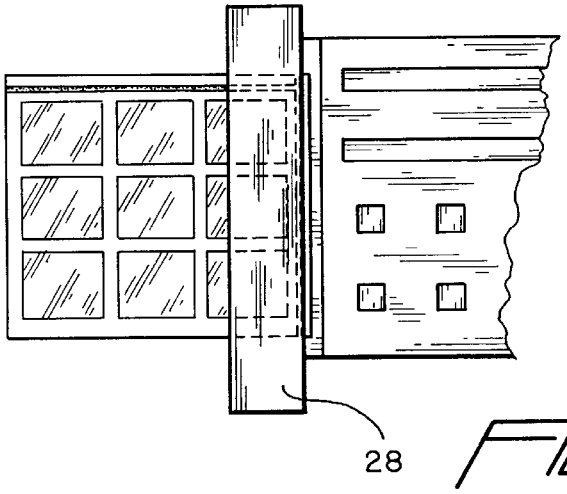

As the sheet approaches the cutter, the sensor 27 first detects the leading edge of the sheet and then the fiducial mark 60. The distance between the sheet leading edge and the fiducial mark is communicated to the controller. The carrier 25, continuing its operation, delivers the sheet to the nip between the registration roller 48 and pinch roller 50. When the leading edge of the sheet butts the nip at the registration roller 48, the carrier 25 is slightly overdriven. This creates a slight buckle near the leading edge to insure that it is seated properly in the nip. The registration roller then is driven, preferably by a stepper motor (not shown) under the control of controller 49 to draw the sheet 11 into cutter mechanism 28. Since the distance between the leading edge of the sheet and the fiducial mark 60 has been communicated to the controller 49, the stepper motor is operated by the controller to drive the registration roller 48 and advance the sheet into the cutter to a first cut position (FIG. 2). At the first cut position, the leading edge of the first row 53A of prints is disposed at the edge of the anvil and below the knife 32. The clamps 38 then are pivoted to a closed position, which clamps the sheet to the anvil. After clamping, the knife 32 is drawn along the support mandrel 34 to make an initial cut.

The initial cut removes a strip from the sheet including the fiducial mark 60 and a small portion of the over printing to the trailing side of the fiducial mark. The cut off strip drops into the waste collector 40 aided by augers 41 (FIG. 7) that pull the waste through the opening 42 and into the receptacle 43.

Figure 3:
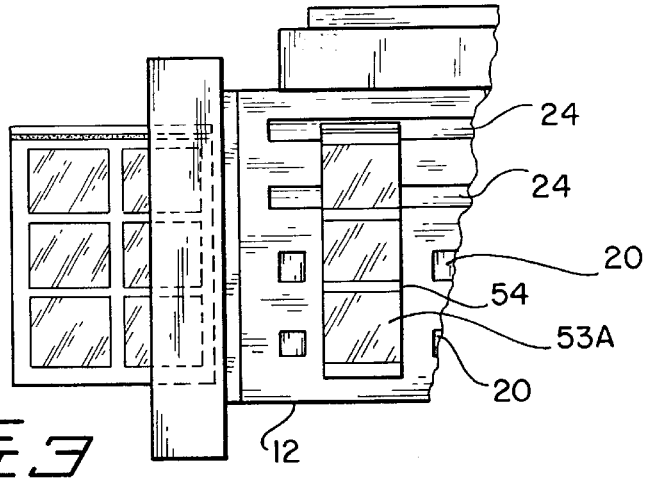

After the initial cut is made, the clamps are pivoted to an open position to release the sheet. The stepper motor for driving the registration roller is again activated. The controller 49 next causes the registration roller to draw the sheet to a position for making a second cut and stops. As noted above, the length of the first row 53A (distance between leading edge 54 and trailing edge 56) is a known dimension. Accordingly the registration roller 48 is operated by the stepper motor under the control of the controller 49 so as to index the sheet a distance sufficient to locate the trailing edge of the first row at the cutting location. The clamps 38 again are pivoted into a clamping position to hold the sheet for the second cut. The second cut is performed as before. In making the second cut, the knife cuts into the overprinted area at the trailing edge of the row so the first row 53A of prints is severed from the sheet. At this point the registration roller operates to move the strip comprising the first row of prints 53A onto the cutter transport table 12 (FIG. 3).

As the strip is moved onto the cutter table 12, the idler rollers 44 are lowered and the driven rollers 20 (also under the control of controller 49) are powered for moving the strip longitudinally across the transport table to the opposite end 16 (FIG. 4). The translation longitudinally across the transport table stops when the strip contacts a stop 51 at the opposite end 16 or a sensor (not shown) detects the leading edge 54 of the strip (FIG. 3). Either event triggers the lifting of the longitudinal idler rollers 44 and stops the rotation of the driven rollers 20.

Figure 10:
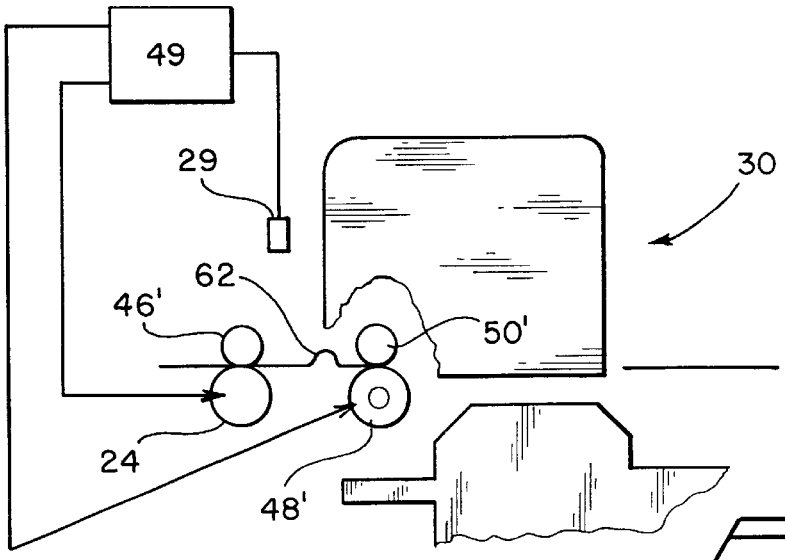
FIG. 10 is a view similar to FIG. 7 only showing a portion of a cutter at an exit end of the table.

The lateral idler pinch rollers 46 (FIG. 9) then are lowered to press against the strip and power is applied to the driven lateral rollers 24 to move the strip in a transverse direction across the transport table as shown by arrow 26 and into the cutter 30 (FIG. 4). As the strip approaches the cutter 30, the sensor 29 first detects the lateral edge of the sheet and then the fiducial mark 61. The distance between the lateral edge and the fiducial mark is communicated to the controller 49. The lateral rollers 24 continue to move the strip into the cutter until the edge is driven into the registration nip between the registration roller 48' and the pinch roller 50' in cutter 30 (FIG. 10). At this point the registration roller is stationary and the lateral drive rollers 24 are over driven to create a small buckle or loop 62 in the strip as shown in FIG. 10.

Overdriving the lateral roller 24 to create the buckle insures that the edge of the strip is well referenced to the registration roller 48' and insures a proper orthogonal orientation of the strip prior to being drawn into the cutter. After the buckle is created, the lateral roller 24 is stopped and the registration roller 48' is activated. The idler pinch rollers 46 are kept in contact with the driven roller 24 until after the edge of the strip has been pulled in to the nip with the registration roller 48'. This insures no loss of location. The pinch idler rollers 46 are then released so the registration roller 48' can draw the strip into the cutter.

Since the distance between the edge of the strip and the fiducial mark 61 is known, the registration roller 48' can be operated to position the strip at the appropriate cutting position. Clamps in the cutter 30 similar to clamps 38 are pivoted to a closed position to clamp the strip at the cutting position. A first cut that includes a portion of the over printing then is made and the leading edge waste is drawn into a waste collector 64 adjacent the transport table outlet end 18.

Figure 6:
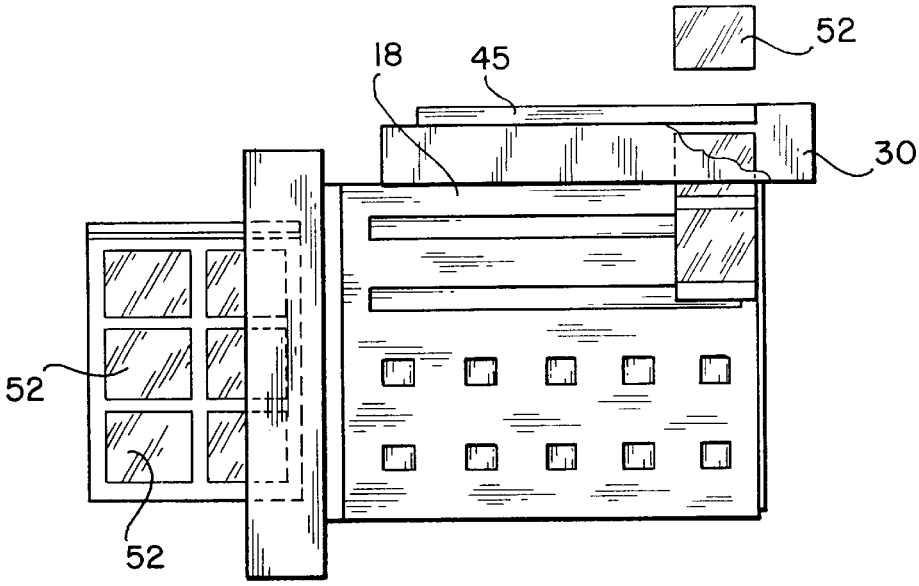

The registration roller in cutter 30 is again activated to advance the strip farther into the cutter mechanism 30 by a distance sufficient to locate the trailing edge of the image at a cutting location. Since the width of the print is known, the registration roller within the cutter 30 under the control of a stepper motor (not shown) can advance the strip so as to position the trailing edge of the print for a second cut. Making the second cut separates a first print 52 in the row and the print, now cut to size, is delivered to a print stacker (not shown) at the outlet end 18 of the transport table 12 (FIG. 6).

Additional lateral advances and cuts are made until all of the photographic images in the first row 53A are separated and trimmed to size. The next cycle then begins with the longitudinal advance of the next row 53B of prints into the cutter 28.

Accordingly, it should be appreciated that the present invention accomplishes its intended objects in providing a method and apparatus for cutting prints of various sizes from a larger sheet. The apparatus provides for the movement of a sheet of prints along orthogonal paths of travel so that the proper cuts can be made to sever prints of various widths from a larger sheet. The transport table 12 includes roller arrangements that are selectively engaged for moving a sheet in two directions across the transport table. Cutter mechanisms adjacent the inlet and out let end of the transport table include means that cooperate with fiducial marks on the sheet of prints. The cooperation provides for locating the sheet at the proper cutting locations first for severing a strip of photos from the sheet and then severing individual photos from the strip.

Having described the invention in detail, what is claimed as new is:

What is claimed is:

1. A method for separating a sheet of photographic prints into individual prints, the prints being arranged on the sheet in an orthogonal pattern composed of transverse rows, the prints defining each transverse row having aligned leading and trailing edges and the method of separating the prints comprising:

a) moving the sheet of prints longitudinally in the direction of a first path of travel to a first cutting location adjacent the inlet end of a transport table;

b) cutting the sheet along a line perpendicular to the first path of travel to sever from the sheet a first strip containing a first transverse row of prints;

c) receiving the first strip severed from the sheet onto the transport table at the inlet end;

d) selectively moving together a first set of nip rollers arranged at spaced intervals along the transport table for engaging and continuously advancing the first severed strip in the direction of the first path of travel longitudinally across the transport table away from the inlet end and towards a second end of the transport table on the opposite side of the transport table from the inlet end and at the second end, butting the first severed strip against a table stop;

e) moving the first set of rollers apart and disengaging the first set of rollers from the first severed strip;

f) selectively moving together a second set of nip rollers that are orthogonally arranged along side the first set and extend along the transport table from the inlet end to the second end for engaging and advancing the first severed strip transversely across the transport table in step wise fashion in a second path of travel to a second cutting location, the stepwise advance pausing the first severed strip each time a lateral edge of each print advances to the second cutting location, g) cutting the strip transversely at each pause in the movement along a line generally parallel to the first path of travel to sever individual prints from the strip; and h) repeating steps (a) to (g) for a subsequent transverse row of prints for severing individual prints from the sheet.

2. A method as in claim 1 wherein selectively engaging the first and second sets of nip rollers for moving the strip along the transport table in the first and second paths of travel comprise forming a plurality of nips between sets of longitudinally and transversely spaced driven and idler rollers and moving selected idler rollers against an associated driven roller for moving the strip in a selected longitudinal or transverse direction.

3. A method as in claim 1 comprising:

a) providing a fiducial mark along a leading transverse edge of the sheet and in advance of a first transverse row of prints;

b) sensing the fiducial mark before movement of the sheet into the first cutting location;

c) positioning the sheet at the first cutting location in response to the sensing of the fiducial mark;

d) cutting the sheet to sever a leading edge portion of the sheet including the fiducial mark while retaining the memory of the location of the fiducial mark;

e) moving the sheet a given distance with respect to the first cutting location as measured from the retained memory of the position of the fiducial mark, the given distance being the distance to the trailing edge of the first row of prints; and f) cutting the sheet to sever the first strip from the sheet.

4. A method as in claim including clamping the sheet to an anvil prior to each of the cutting operations.

5. A method as in claim 1 comprising:

a) providing a fiducial mark between a lateral edge of the sheet and a lateral edge of a first column of prints;

b) sensing the fiducial mark during the movement of the severed strip into the second cutting location;

c) positioning the strip at the second cutting location in response to the sensing of the fiducial mark;

d) transversely cutting the strip at the second cutting location to sever a leading lateral edge portion of the strip including the fiducial mark while retaining the memory of the location of the fiducial mark;

e) moving the strip a given distance with respect to the second cutting location as measured from the retained memory of the position of the fiducial mark, the given distance being the distance to the trailing lateral edge of the first print in the severed strip; and cutting the strip to sever the first print from the sheet.

6. A method as in claim 1 wherein moving the sheet along a first path of travel into a first cutting location includes:

a) butting a leading edge of the sheet against a nip;

b) overdriving the sheet against the nip to form a buckle at the sheet leading edge and insure the proper seating of the sheet leading edge in the nip; and thereafter c) drawing the sheet leading edge through the nip for locating the sheet at the first cutting location.

7. A method as in claim 1 wherein moving the strip transversely along a second path of travel to the second cutting location comprises:

a) butting a leading edge of the strip against a nip;

b) overdriving the strip leading edge against the nip to form a buckle at the strip leading edge and insure the proper seating of the strip leading edge in the nip; and thereafter c) drawing the strip leading edge through the nip for locating the strip at the second cutting location.

* * * * *

UNITED STATES PATENT AND TRADEMARK OFFICE

CERTIFICATE OF CORRECTION

PATENT NO. : 6,761,097 B2
DATED : July 13, 2004
INVENTOR(S) : Petersen, David Michael It is certified that error appears in the above-identified patent and that said Letters Patent is hereby corrected as shown below:

Column 8,
Line 43, insert -- f) -- before "cutting the strip to sever the first print from the sheet"

Signed and Sealed this

Fourteenth Day of September, 2004

JON W. DUDAS
*Director of the United States Patent and Trademark Office*